US005794706A

United States Patent [19]

Alhamad

[11] Patent Number: 5,794,706

[45] Date of Patent: Aug. 18, 1998

[54] PREVENTION OF CORROSION, FIRE AND EXPLOSION IN OIL WELLS

[76] Inventor: Shaikh Ghaleb Mohammad Yassin Alhamad, P.O. Box 31590 Riyadh, 11418, Kingdom of Saudi Arabia, Saudi Arabia

[21] Appl. No.: 507,148

[22] Filed: Jul. 26, 1995

Related U.S. Application Data

[63] Continuation-in-part of Ser. No. 226,954, Apr. 13, 1994, which is a continuation-in-part of Ser. No. 806,901, Dec. 12, 1991, Pat. No. 5,402,852, which is a division of Ser. No. 674,277, Mar. 19, 1991, Pat. No. 5,097,907, which is a division of Ser. No. 417,696, Oct. 5, 1989, Pat. No. 5,001,017, which is a division of Ser. No. 280,317, Dec. 6, 1988, abandoned.

[51] Int. Cl.[6] ..... A62C 3/06; E21B 35/00

[52] U.S. Cl. ..... 169/69; 169/35; 166/902

[58] Field of Search ..... 169/35, 45, 66, 169/69; 166/251, 188, 230, 902, 250

[56] References Cited

U.S. PATENT DOCUMENTS

| | | | |
|---|---|---|---|
| 1,086,707 | 2/1914 | Hoagland . | |
| 1,671,650 | 5/1928 | Newman et al. . | |
| 3,162,231 | 12/1964 | Emerson | 153/2 |
| 3,313,361 | 4/1967 | McCullough | 169/69 |
| 3,349,953 | 10/1967 | Conaway et al. | 220/85 |
| 3,356,256 | 12/1967 | Szego | 220/88 |
| 3,580,334 | 5/1971 | Broussard | 166/250 |
| 3,687,329 | 8/1972 | Baum | 220/26 R |
| 3,889,757 | 6/1975 | Dunn | 169/59 |
| 3,914,095 | 10/1975 | Straitz, III | 431/202 |
| 3,933,444 | 1/1976 | Kilgore | 48/192 |
| 4,143,715 | 3/1979 | Pavlich | 169/69 |
| 4,149,649 | 4/1979 | Szego | 220/88 A |
| 4,249,669 | 2/1981 | Szego | 220/216 |
| 4,265,317 | 5/1981 | Knecht | 169/50 |
| 4,361,190 | 11/1982 | Szego | 169/48 |
| 4,405,076 | 9/1983 | Lines, Jr. et al. | 428/921 |
| 4,440,227 | 4/1984 | Holmes | 166/251 |
| 4,613,054 | 9/1986 | Schrenk | 220/88 R |
| 4,621,397 | 11/1986 | Schrenk | 29/6.1 |
| 4,958,558 | 9/1990 | Spaeth | 169/48 |
| 5,158,144 | 10/1992 | Shaw et al. | 169/46 |
| 5,232,308 | 8/1993 | Verstraeten | 169/69 |

FOREIGN PATENT DOCUMENTS

| | | | |
|---|---|---|---|
| 256239 | 2/1988 | European Pat. Off. . | |
| 339278 | 11/1989 | European Pat. Off. | 169/45 |
| 601374 | 11/1925 | France . | |
| 2440892 | 6/1980 | France . | |
| 2602976 | 2/1988 | France . | |
| 3435457 | 4/1986 | Germany . | |
| 683396 | 3/1994 | Switzerland | 169/66 |
| 0588986 | 1/1978 | U.S.S.R. | 169/69 |
| 419229 | 3/1994 | U.S.S.R. | 169/45 |
| 760861 | 11/1956 | United Kingdom | 169/45 |
| 2028129 | 3/1980 | United Kingdom . | |
| 8500113 | 1/1985 | WIPO . | |
| 9422536 | 10/1994 | WIPO | 169/45 |

OTHER PUBLICATIONS

Dyer et al. "Testing of Flame Screens and Flame Arresters", USCG Marine Fire & Safety Res.Div. Report CG-M-3-90, Oct. 1989, pp. 1-2, 57-60.

Wilson et al. "Design Criteria for Flame Arresters", Loss Prevention 12, 86-95, 1979.

(List continued on next page.)

*Primary Examiner*—Virna Lissi Mojica
*Attorney, Agent, or Firm*—Charles E. Cates; Frank T. Barber

[57] ABSTRACT

A highly effective module for preventing corrosion of oil well pipes and equipment and for preventing resulting fires and explosions. The module is a collar formed from slitted and expanded metal net and is adapted to fit in the annular space between the oil production pipe and the outer casing of the oil well, to prevent oxygen from the atmosphere from entering the annular space at the top of the well, and to exclude hydrocarbon vapors from the subterranean production zone from entering the annular space at the bottom of the well. The invention also relates to methods for extinguishing a burning oil well.

16 Claims, 8 Drawing Sheets

OTHER PUBLICATIONS

Raychem Brochure "CryoFit", Menlo Park, CA, Jul., 1989.
Raychem Brochure "CryoFit", Menlo Park, CA, Mar., 1991.
Kuchta, J., "Investigation of Fire and Explosion Accidents", U.S. Bureau of Mines Bulletin 680, 1985, pp. 34–35,41–48, 62–65.
Hearn, G., "Coping with Electrostatic Hazards", Chem. Engineering, p. 188, Nov. 1991.
Horvath, T. et al, "Static Elimination", John Wiley & Sons, 1982, pp. v, 9–17.
Block, L., "Improving Gas Appliance Safety", Appliance Engineer, pp. 40–45, Dec. 1988.
Potter, A., "Flame Quenching", Progress in Combustion Science and Technology, 1, 145–181, Pergmon Press, 1960.
"Revised Standards for Design, Testing, and Locating, etc.", Mari–time Safety Commission Circular 373/Rev. 1, May 1988, pp. 1–3,9–11.

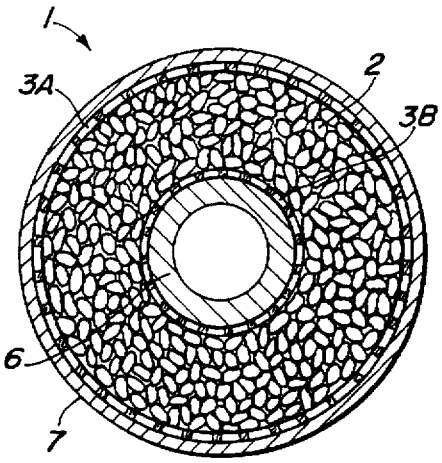
FIG. 1
FIG. 1A
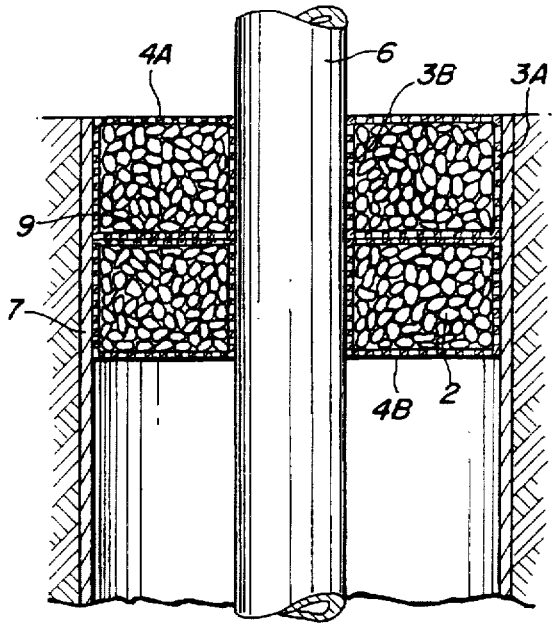
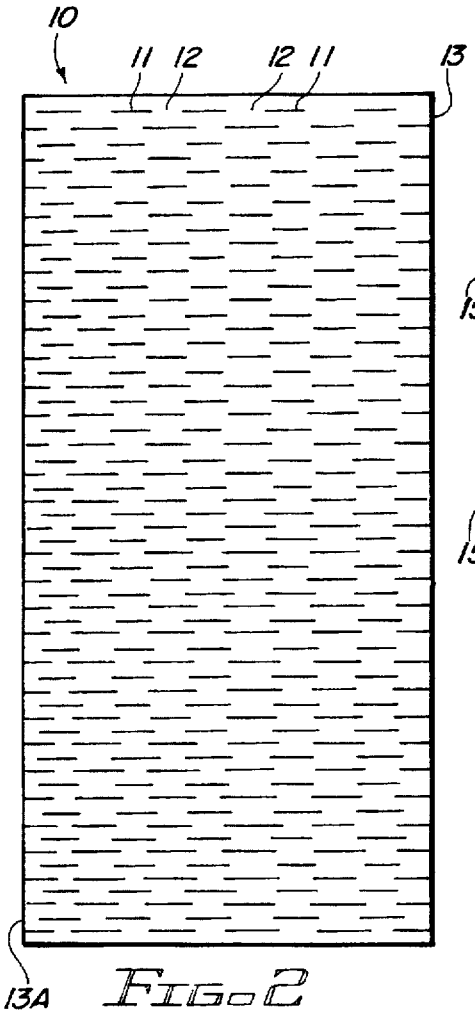
FIG. 2
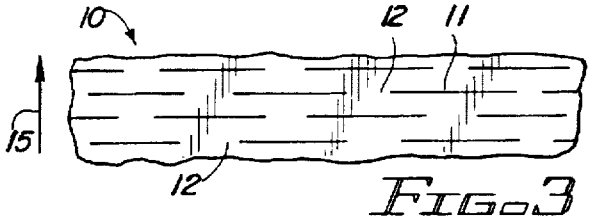
FIG. 3
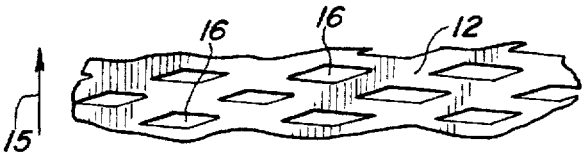
FIG. 4
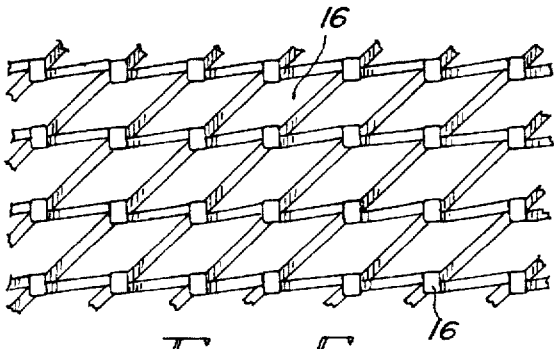
FIG. 5

PREVENTION OF CORROSION, FIRE AND EXPLOSION IN OIL WELLS

This application is a continuation-in-part of pending application Ser. No. 226,954, filed Apr. 13, 1994, which is a continuation-in-part of application Ser. No. 806,901, filed Dec. 12, 1991 (now U.S. Pat. No. 5,402,852, issued Apr. 4, 1995), which was a division of application Ser. No. 674,277, filed Mar. 19, 1991 (now U.S. Pat. No. 5,097,907, issued Mar. 24, 1992), which was a division of application Ser. No. 417,696, filed Oct. 5, 1989 (now U.S. Pat. No. 5,001,017, issued Mar. 19, 1991), which was a division of application Ser. No. 280,317, filed Dec. 6, 1988 (now abandoned).

FIELD OF THE INVENTION

This invention relates generally to devices for protecting oil wells against corrosion and against fire and explosion, particularly the kinds of corrosion, fire and explosion which occurs in the down-hole pipes and in the annular spaces therebetween. The invention also relates to methods for extinguishing the flame of a burning oil well gusher and returning the oil well to a normal condition.

Oil well configurations exist in many different forms, and it is difficult to describe a "typical" design. The designs vary with the practices of the contractors, the regions in which they work (i.e., local regulations), the availability of expertise and supplies in a region, budgets available, potential of the well, age of the well, the formation conditions, and hundreds of other factors. However, in most configurations, there is an outer casing and a concentrically positioned inner production tubing. The outer casing is usually the original (drilling phase) casing which is telescoped down the hole with progressively smaller dimensions and which is generally secured in place with cement. The production tubing is hung inside the casing and is used to bring fluids from the producing zone up to the surface. In some wells, intermediate liners or casings are installed in the annular space between the outer casing and the inner production tubing. To simplify the description of the present invention, the term "casing" will be used to refer to either the outer casing or the intermediate liner or casing which is sometimes used. The present invention focuses on the annular space between the outside of the inner production tubing and the inside of the casing (whether the casing be the original drilling casing or the liner/casing positioned inside thereof.

The primary enemy of an oil well is corrosion of the casing and/or the inner production tubing, as well as the associated pumps, valves and other tools which are located in the well. Corrosion of the casings and tubings and tools causes equipment failure resulting in perforations of the pipes, which in turn leads to formation gases entering the annular space and rising within that space to the top of the well, while continually expanding due to a lowering in formation pressure as the gas advances to the surface. If this gas is ignited in any way, there will be fire and explosion and potential destruction of the well and surrounding facilities.

Corrosion such as described above is caused by numerous factors such as the introduction of fuel, water, oxygen, hydrogen sulphide, carbon dioxide and caustics in the produced fluids. A primary cause of corrosion is the exposure of the pipes to air and moisture, and to stray electrical currents, in the annular space surrounding the inner production tubing. This annular space is usually filled with a solution called a "production fluid". This fluid is most often a brine, and although it is conventional to include corrosion inhibitors in the brine, this is not a completely effective means for avoiding the failure of the pipes due to corrosion. Pipes become scratched during installation, and corrosion inhibitors break down over a period of time, as a result of other additives, like caustic soda, which are used as cleansing agents and for related purposes. Under such conditions, any oxygen which makes its way into the annular space combines with the moisture to produce corrosive destruction and failure of the pipes and associated tooling. The corrosion is not only detrimental in terms of causing costly pipe repairs and tool replacement but also in creating ideal conditions for fire and explosion, as described above.

In spite of the well-developed state of oil well technology, there is a continuing need for more effective anti-corrosion measures, as well as a need for preventing down-the-hole fires and explosions. There is also a need for extinguishing fires which are caused by events other than corrosion or carelessness, such as those resulting from terrorist or military activities, as in the Kuwait oil fields following the Gulf War in 1991.

It is an object of the present invention to provide a down-the-hole module which possesses the dual capability of preventing corrosion and also preventing or suppressing the spread of fires or explosions which might otherwise occur.

It is another object of the invention to provide a module which is extremely light, durable, simple and inexpensive to manufacture, easy to assemble, and relatively maintenance-free.

It is a further object to provide a method of extinguishing the flame of burning oil well gushers.

Other objects and advantages of the invention will become apparent as the specification proceeds.

SUMMARY OF THE INVENTION

This invention is based on the discovery that oxygen and explosive vapors can be excluded from the annular space surrounding the downhole production pipe of an oil well by the presence in said annular space of one or more modules or collars formed from slitted and expanded metal net. It has been found that the module or collar is effective in preventing corrosion of the downhole pipes and in preventing or suppressing fire or explosion in said annular space.

In a typical oil well configuration, oxygen from the atmosphere penetrates into the brined production fluid at the upper, wellhead end of the well and disperses downwardly in the annular space between tubing and casing, where it cooperates with moisture to corrode the steel piping of the well. However, according to the present invention, a collar comprised of slitted and expanded metal net placed in the annular space at the wellhead end of the well effectively prevents oxygen entry into the annular space and thus precludes corrosion. Likewise, a collar of slitted and expanded metal net placed in the annular space at the lower end of the well, adjacent the production zone, prevents hydrocarbon vapors in the production zone from entering the annular space and thus precludes the possibility of fire and explosion which might result from ignition of such vapors.

It is a feature of the invention that the collar of expanded metal net located at the wellhead end of the well also acts as a highly effective flame arrester. Accordingly, in the event that a flammable mixture of hydrocarbon vapor and oxygen does in fact accumulate in the annular space and in fact is ignited, the resulting flame is effectively arrested by the collar of the present invention and is prevented from passing through the wellhead and enveloping the surrounding surface facilities. The invention therefore provides the dual function of precluding oxygen and hydrocarbon vapors from entering the annular zone and also arresting the outward passage of any flame that might otherwise be created within said zone.

The effectiveness of the module of the present invention is attributable in part to the very high internal surface area which is attainable with the slitted and expanded metal net of the invention. In a preferred form of the invention, the module has a specific internal surface area above 250 square feet per cubic foot. This open-structured configuration, with substantially enhanced internal surface area, not only produces significant flame arresting properties but also provides the mechanism for excluding oxygen and hydrocarbon vapors.

The module of the invention may be one or more sheets of slitted and expanded metal foil, formed in the shape of a collar or batt to occupy the annular space at strategic points in the well, or it may be a contained body of nested ellipsoids formed from expanded metal sheets. For example, the body of nested ellipsoids may be contained between sheets of slitted and expanded metal foil, or between sheets of metal woven mesh, formed in the shape of a collar to occupy the annular space.

The invention also comprises a method for extinguishing the flame of a burning oil well gusher comprising placing a body of slitted and expanded metal foil in a position above the wellhead end of the production pipe from which the flaming oil is issuing and maintaining such position until the flame is extinguished. The method has an improved effectiveness when the body comprises contained ellipsoids formed from slitted and expanded metal foil. The very high internal surface area of such a body interferes with the ability of the burning hydrocarbon to maintain the temperature and vapor pressures necessary to support the existence of a flame, and the fire is thus extinguished. In a preferred embodiment, the flow of oil in a gusher which has thus been extinguished is turned off by shrink fitting a shut off valve on to the well head end of the production pipe and closing the valve.

BRIEF DESCRIPTION OF THE DRAWINGS

FIG. 1 is a top view of a collar of present invention, showing use of nested ellipsoids formed from expanded metal net.

FIG. 1-A is a cross-sectional view of the collar of FIG. 1, positioned in the annular space between the casing and the production pipe of an oil well.

FIG. 2 is a top view of a slitted metal foil sheet, which can be expanded by stretching to provide the expanded metal net usable in the present invention.

FIGS. 3 through 6 are top views of the expanded metal net, showing changes in configuration as the slitted sheet is pulled to open up the expanded metal net.

DETAILED DESCRIPTION OF THE INVENTION

Figure 6:
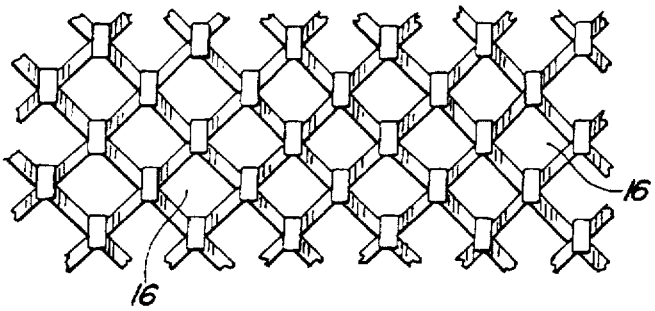

Referring to the drawings, the basic structure of the module or collar of the present invention is shown in FIGS. 1 and 1-A, wherein the collar 1 includes a body of nested ellipsoids 2 contained between sheets 3A and 3B of expanded metal net, woven screen, or other containment material, and between top and bottom sheets 4A and 4B sheets of expanded metal net. The doughnut-like shape of the module with its central opening 5 permits it to be slipped over the inner production pipe 6 of an oil well and thus fill the annular space 8 between the pipe 6 and the casing 7.

The invention is not limited to using only two sheets 4A and 4B to contain a single core layer of ellipsoids 2. In addition to its effectiveness in preventing entry of oxygen and hydrocarbon vapors into the annular space 8, the module also provides significant flame arresting properties, and for this purpose it may also be advantageous to employ multiple core layers of ellipsoids 2, separated by one or more sheets 9 of expanded metal net. It is also useful in some environments to employ two or more sheets of metal net 4A, 4B or 9 in contact with each other in a single layer.

The kind of metal used in the slitted metal foil may be selected from a wide number of metals or alloys which may be produced in the form of a thin foil. A particularly useful embodiment of the invention involves expanded metal nets made from alloys of magnesium with certain other compatible substances. More specifically, in this embodiment of the invention, it is especially useful to use an alloy of magnesium with substances such as aluminum, copper, zirconium, zinc, strontium, Rn(electron), silicon, titanium, iron, manganese, chromium, and combinations thereof. Alloys such as the above have the valuable characteristics of not only being lightweight, strong, elastic, heat-conductive, etc., but also the important characteristic of being nonflammable. A particularly useful combination is the alloy of magnesium with aluminum and copper. Another preferred combination is the alloy of magnesium with zirconium and strontium. The invention is illustrated in a specific example by an alloy comprising 0.25% Si, 0.3% Fe, 0.01% Cu, 0.01% Mn, 10% Al, 0.1% Zn, 0.08–0.1% Ti, and the remainder Mg. Such a product possesses tensile strength of 300N/mm , proof stress of 200 n/mm, elongation of 10%, and Brinell hardness of (5/250-30). The magnesium alloy used in the invention should contain at least 0.5% by weight of magnesium.

In addition to the magnesium alloys referred to above, other materials may be used in the practice of the invention. Thus, for certain uses, it is possible to use foils made of aluminum, steel, copper, manganese, zinc, chrome, and alloys thereof. Aluminum and aluminum alloys are especially suited for certain applications.

The metals and alloys referred to above may also be alloyed or combined with non-metal components such as carbon. Thus, the objects of the invention can be achieved with materials such as aluminum/carbon alloys, magnesium/carbon alloys, and the like. A typical useful alloy of this nature comprises either an alloy of aluminum, or magnesium, or steel, or copper, or manganese, or zinc, or chrome, containing from 0.01 to 0.03 carbon.

For certain uses, the product of the present invention may be combined with other materials. For example, if the expandable metal foil is coated with an alkaline bichromate, the corrosion inhibition of the expanded net is enhanced. Further, if the metal foil is combined with oleates or similar compounds, the fire extinguishing capability of the expanded net is enhanced, since the oleate emits a dense vapor which covers the burning material and assists in the smothering of the flame.

The expanded metal employed in producing the ellipsoids 2 and the sheets 3A, 3B, 4A, 4B and 9 is formed by slitting a continuous sheet of metal foil in a specialized manner and then stretching the slitted sheet to convert it to an expanded prismatic metal net having a thickness substantially greater than the thickness of the foil. Referring to the drawings, FIG. 2 shows a sheet of metal foil 10 provided with discontinuous slits appropriate for the present invention. The length and width of the sheet may be chosen from any number of practical dimensions, depending on the size of the module to be produced.

As noted in FIG. 2, sheet 10 is provided with discontinuous slits 11 in spaced apart lines which are parallel to each other but transverse to the longitudinal dimension of the sheet 10. The slits 11 in each line are separated by unslit segments or gaps 12, and it will be noted that the slits 11 in each line are offset from the slits 11 in adjacent lines. Similarly, the gaps 12 in each line are offset from the gaps 12 in adjacent lines. The lines of slits run perpendicular to the longitudinal edges 13 and 13A of the continuous sheet of metal foil. Methods and apparatus for producing the slitted metal foil are described in detail in U.S. Pat. No. 5,095,597, dated Mar. 17, 1992 and U.S. Pat. No. 5,142,735, dated Sep. 1, 1992.

When the slitted metal foil as shown in FIG. 2 is stretched by subjecting it to longitudinal tension, it is converted into an expanded metal prismatic net, usable as elements 3A, 3B, 4A, 4B and 9 of the present invention. In the stretching procedure, the horizontal surfaces of foil are raised to a vertical position, taking on a honeycomb-like structure. This conversion is shown in FIGS. 3 through 6 of the drawings. The slitted metal foil 10 is shown in FIG. 3 prior to stretching. When longitudinal tension is applied in the direction of arrow 15, the slits 11 begin to open and are converted to eyes 16, and the product assumes the appearance shown in FIG. 4. The application of more tension causes a greater opening of the slits, and the product expands into the honeycomb-like, prismatic form shown in FIG. 5. When even further tension is applied, the configuration reaches its desired end point, as in FIG. 6. The conversion illustrated in FIGS. 3 through 6 is accompanied by an increase in thickness of the product, the final thickness of the honeycomb product being approximately twice the value of the space 14 between each line of slits. Each eye of the expanded sheet has a three-dimensional structure having eight corner points.

Figure 7:
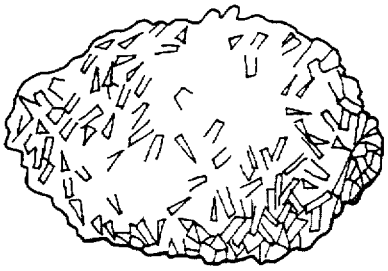
FIG. 7 is a perspective view showing the ellipsoid form made from the expanded metal net, for use in the present invention.
Figure 10:
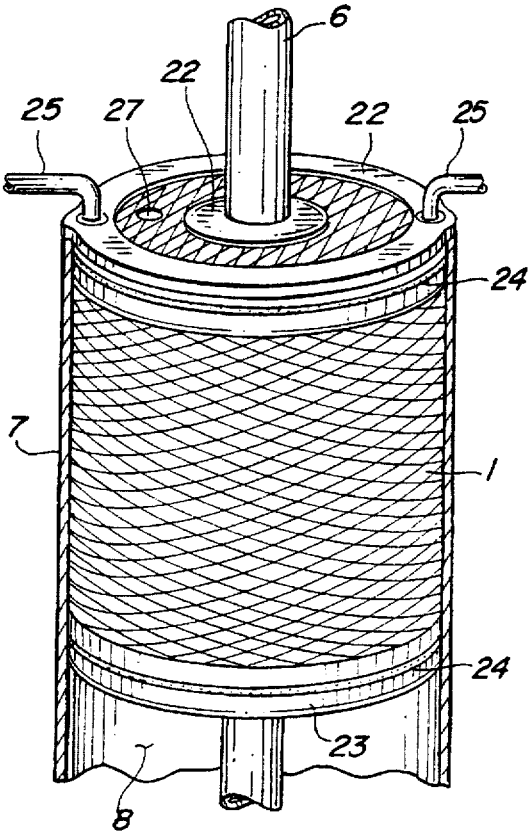
FIG. 10 is a perspective view of one of the modules of the present invention.

The ellipsoids 2 are produced by cutting the expanded metal net into small segments which are then mechanically formed into small ellipsoids, as illustrated in FIG. 7. The ellipsoids 2 generally have a short diameter in the range of 20 to 40 mm, and a long diameter in the range of 30 to 60 mm, with the distance between focal points measuring approximately two-thirds of the long diameter of the ellipsoid. Their ellipsoid shape causes them to nestle closely together when placed in a contained position, so that complete surface coverage is obtained, with no gaps through which flames or beams can pass. Apparatus for producing these ellipsoids is described in detail in U.S. Pat. No. 5,207,756, date May 4, 1993.

For usage in the present invention, the thickness of the foil used to produce the metal net should be in the range between 0.028 and 1.0 mm, and the preferred thickness is between 0.2 and 1.0 mm. The length of each slit 11 is in the range between 1 and 2.5 cm, and the unslit sections or gaps 12 between each slit are in the range between 2 to 6 mm long. The distance 14 separating lines of slits may be varied but is ordinarily in the range between 1 and 4 mm, so that the thickness of the resulting expanded metal net is normally in the range between 2 and 8 mm. The preferred value for distance 14 is 2 to 4 mm.

By controlling the extent of stretching of the slit foil, as well as the dimensions of the slits 11, the gaps between slits, and the spaces 14 between lines of slits, it is possible to take advantage of the strength, hardness and other properties of the alloy foil to produce expanded nets which may be formed into modules or collars having exceptionally high specific internal surface areas (e.g., in the range of 250 to 325 $ft^2$ per $ft^3$) and above; exceptionally high porosity (e.g., in the range of 80 to 99%) and a volume resistivity of <50 ohm-m. These characteristics make the expanded metal net particularly useful in terms of flame-arresting and anti-explosion properties, as will be explained later in greater detail.

Figure 8:
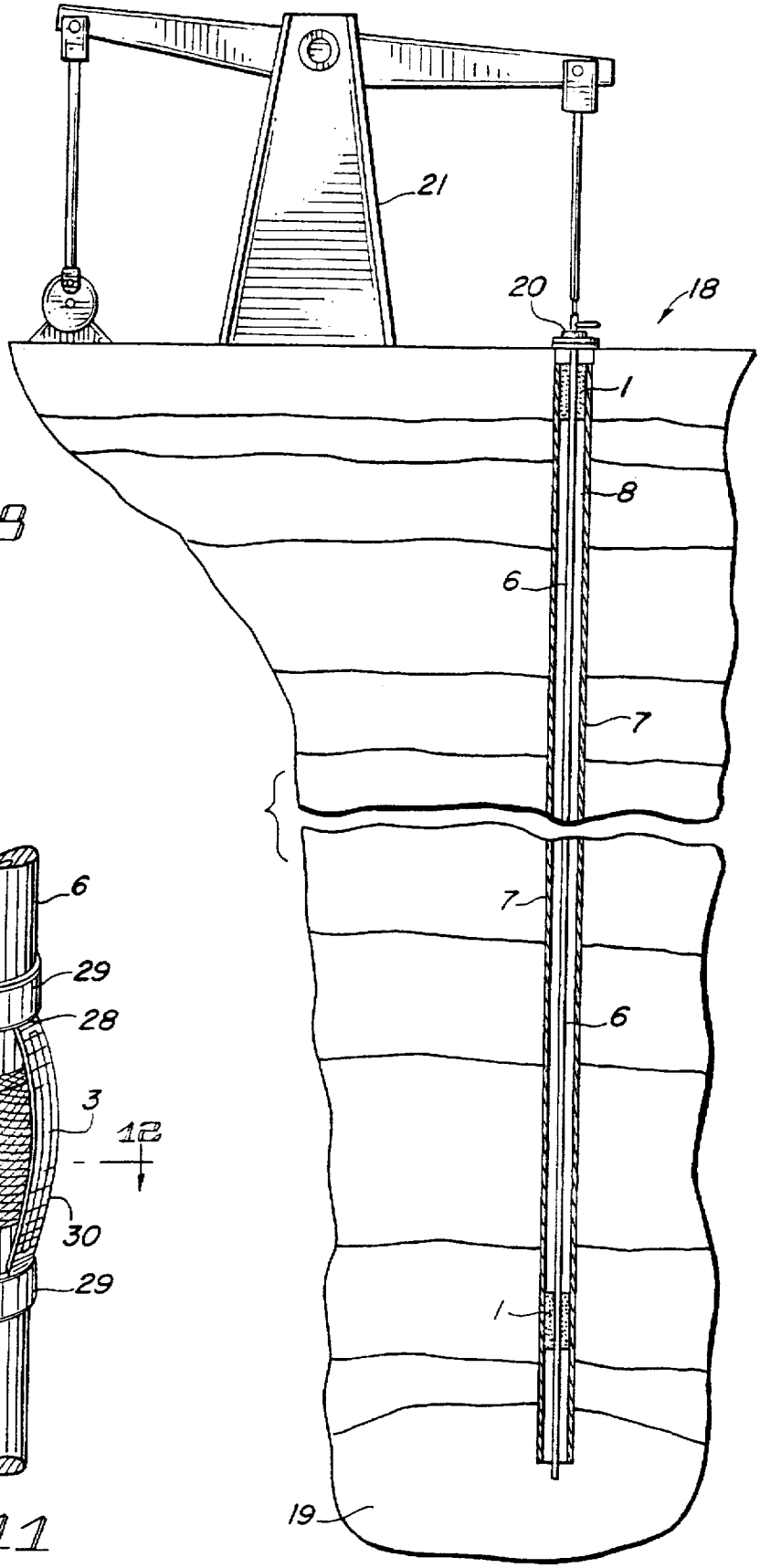
FIG. 8 is a cross-sectional view of an oil well configuration, showing modules of the present invention in position at the wellhead and production zone ends of the well.

FIG. 8 represents a typical oil well configuration in which the present invention may be employed. The drawing schematically illustrates a hole which has been drilled in a rock formation, communicating between the surface 18 and the subterranean oil producing zone 19. A casing 7, comprised of the original drilling phase tubing, has been cemented to the walls of the hole. An inner production pipe 6 provides access at its lower end to the subterranean oil producing zone 19 and communicates at its upper end with the oil handling assembly 20 at the surface of the well. Unless the well is naturally flowing because of pressure in the reservoir, there will normally be a pump 21 at the surface to suck the oil from the producing zone.

Between the outside surface of the production pipe 6 and the inside surface of the casing 7, there is an annular space 8 which extends throughout the length of the piping from the surface 18 down to the production zone 19. This annular space is the focus of the present invention. It will be understood that, if the well configuration includes a liner pipe between the outer casing and the inner production tubing, then the annular space in question is the space between this intermediate liner pipe and the inner production tubing. For the purposes of the present description, the term "casing" includes either the outer casing or the intermediate liner/casing, and the annular space refers to the space immediately surrounding the inner production tubing. The annular space is usually filled with a solution called "production fluid" and normally has a dimension of about 2 to 3 inches, to permit the passage of tools up and down in the well. Oxygen and moisture tend to penetrate into this space, and these conditions favor corrosion of the casing and the production pipe. The corrosion in turn causes failure of the pipes and the admission of flammable and explosive hydrocarbon gases.

Figure 9:
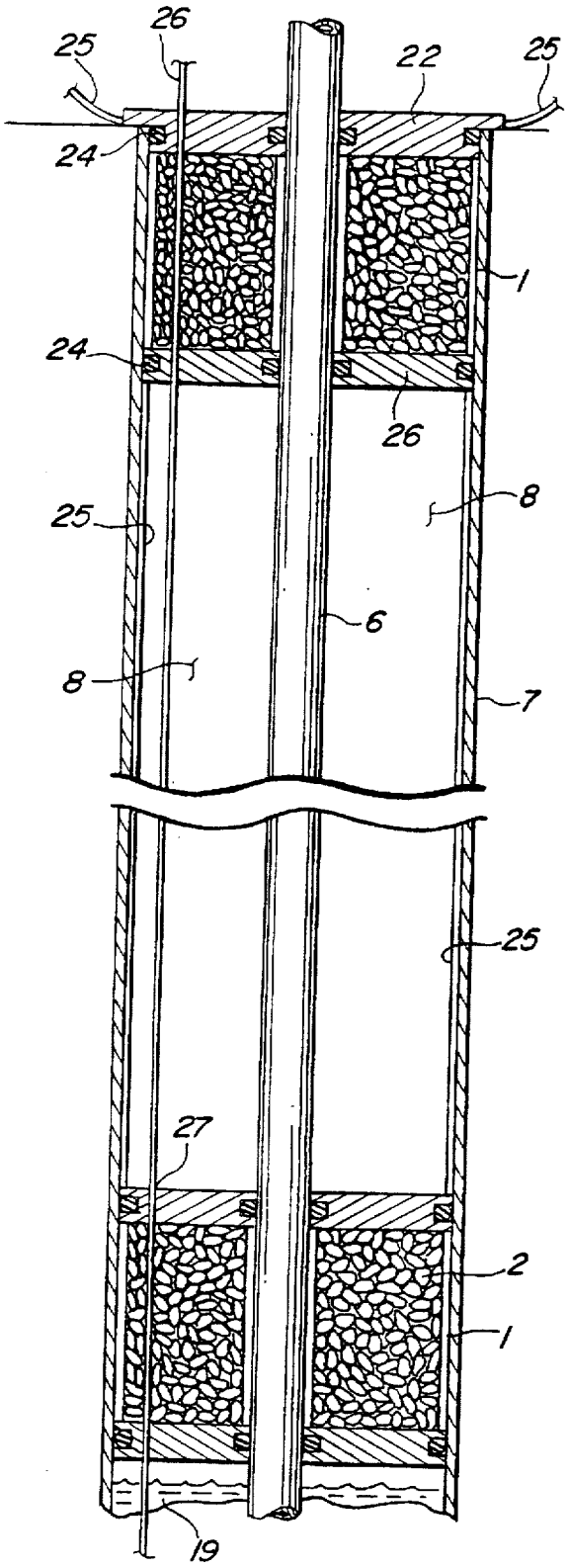
FIG. 9 is an enlarged cross-sectional view of the wellhead and production zone ends of a well, with the modules in position.

As shown in FIGS. 8 and 9, the module or collar 1 of the present invention is installed in the annular space 8 at a point adjacent the wellhead, and another such collar 1 may be installed in the lower end of the well at a point adjacent the oil producing stratum or zone. In the embodiment shown in greater detail in FIG. 9, the module which is adapted for installation adjacent the wellhead includes an upper circular frame 22 and a lower circular frame 23 for containing the collar 1 in the annular space 8 between the production tubing 6 and the casing 7. Large O-rings 24, made of rubber or other compressible sealing material, form a seal between the frames 22 and 23 and the inner wall of the casing 7. The collar 1 is formed from expanded metal net, either in sheet or batt form or as a body of nestled ellipsoids made from the expanded metal net.

The module which is adapted for installation at the bottom end of the well is of similar construction. The bottom module is fitted with retrieval cables 25 which extend the length of the well, and which pass through the upper module and are anchored at the surface. The cable arrangement permits the modules 1 to be readily removed from the well for inspection and servicing. An additional cable 26, for use in electrical control of subsurface equipment, passes through passages 27 in both the top and bottom modules.

With the modules 1 in place at the upper and lower ends of the well, as shown in FIGS. 8 and 9, the annular space 8 is protected against ingress of oxygen (from the atmosphere) and hydrocarbon vapors (from the production zone), and thus the elements which contribute to corrosion, fire and explosion are not available in the annular space. This protection is accomplished with modules or collars 1 which are made from very lightweight, inexpensive, and readily manufactured and serviced materials—namely, the slitted and expanded metal foil. Moreover, the unique open network structure of the collars of the present invention provides an additional benefit in the form of a very high specific internal surface area, which enables the collars to operate effectively as flame arresters without interfering with their ability to prevent the ingress of oxygen and hydrocarbon vapors. Collars such as those illustrated herein have specific internal surface areas in the neighborhood of 320 $ft^2$ per $ft^3$, which qualifies them as flame arresters for substantially all classes of fuels or flammable vapors. Thus, in the event of accidental fire occurring in the annular space, the collars 1 arrest the spread of the flames to vulnerable surface facilities or to the subterranean producing zone. Likewise, in the event of accidental fires occurring at the wellhead or in the subterranean areas, the collars 1 arrest the spread of flames into the annular space 8.

Still further, the structure of the collars 1 of the present invention has the surprising capability of dissipating shock waves resulting from explosions. Tests with anti-explosion pads or collars comprising nested ellipsoids formed from expanded metal net have demonstrated remarkable protection against destructive forces of an explosion. For example, a 3½ inch thick barrier pad made from the components of the present invention has a "scaled distance" explosion protection rating of 0.7 $ft/lb^{33}$ and is capable of reducing the overpressure of an explosion from 1000 pounds per square inch down to 200 pounds per square inch. In other words, such a barrier pad provides non-reinforced concrete block wall with a resistance to explosion damage equivalent to a steel-reinforced block wall. Thus, with the collars 1 in place at the upper and lower ends of the annular space 8, the force of an accidental explosion occurring within the annular space is effectively suppressed.

The flame arresting and explosion protection properties of the collar 1 may be enhanced by using multiple layers of sheets of expanded metal net and contained ellipsoids. Thus, as illustrated in FIG. 1-A, the collar 1 may comprise a layer of nested ellipsoids 2 contained between an upper sheet 4A of expanded metal net and a lower sheet 9 of expanded metal net, and this may be supplemented by a second layer of nested ellipsoids 2 contained between the sheet 9 of expanded metal net and the lower sheet 4B of expanded metal net. Additional layers may be added, depending upon the degree of flame arresting and blast protection desired.

The dimensions of the collar 1 will of course vary depending on the size and configuration of the oil well. The outer casings range from 25 inches (I.D.) progressively down in size to as low as 3.5 inches (I.D.). Liner casings range from 7 inches to 4.5 inches (O.D.) or 6.375 inches to 3.875 inches (I.D.) Production tubing of course has a smaller diameter, depending on the size of the casings or liners being used, the customs of the area, the pressures in the well, etc. A typical liner size now being sold is 5.5 inches (O.D.) and 5.2 inches (I.D.). The size of the production tubing for this size liner would be 2⅞ inches (O.D.) and 2.44 inches (I.D.), so that the "drift size" of the annular space would be approximately 0.3 inches. The collar 1 of the present invention is dimensioned to fit this space. The thickness of the collar 1 (i.e., the distance between the circular frames 22 and 23) will vary depending on the size of the well, but in most instances will be in the range of 32 to 48 inches.

Figure 12:
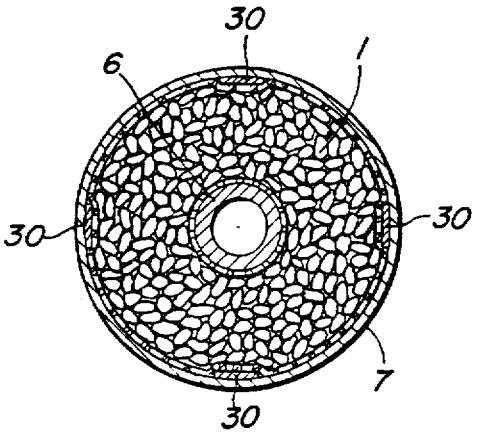
FIG. 12 is a top cross-sectional view of the module of FIG. 11.
Figure 11:
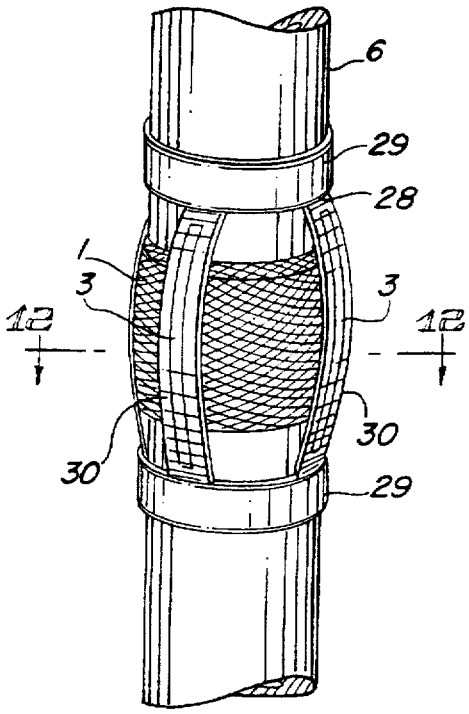
FIG. 11 is a perspective view of one of the modules positioned as part of a centralizing device attached to the production tube of an oil well.

FIGS. 11 and 12 illustrate an alternate embodiment for positioning the collar 1 at the desired places adjacent the upper and lower ends of the well. In this embodiment, the collar 1 is held in place by use of conventional centralizing devices which are used to hold the production tube 6 centered within the casing 7, rather than randomly floating and sometimes touching the inside of the casing. Centralizing devices are spaced at intervals down the length of the well and are essential for maintaining a constantly dimensioned annular space for the passage of tools and equipment. A typical centralizing device 28 is shown in FIG. 11. It comprises a pair of spaced apart rings 29 adapted to encircle the production pipe and multiple spaced apart slats 30 having their ends secured to said rings 29 and being vertically positioned therebetween, with their midsections 31 bowed outwardly away from the production pipe 6 and in contact with the casing 7. The arrangement of the centralizer 28 permits a collar 1 of the present invention to be positioned between the rings 29, inside the slats 30 and therefore in the annular space 8 between the production pipe 6 and the casing 7. The centralizers located adjacent the surface end and the production zone end of the well may be used for holding the collars 1 in this manner. The drawing of FIG. 12 shows a cross section of the oil well with a collar 1 of the present invention in place inside a centralizer having four slats 30 placed at spaced apart vertical positions in the annular space.

FIGS. 13 through 25 show an embodiment of the invention in which a body of slitted and expanded metal foil is used to extinguish the flame of a burning oil well gusher. This embodiment applies to oil well fires which are caused by accidental occurrences, such as explosions at the wellhead, or by terrorist or military activities, such as dynamiting the wellhead assembly and igniting the resulting gusher of oil. In oil well fires, the gusher may be as high as 30 meters, and the temperature of the flaming gusher is in excess of 1,000 F. It is this extremely high temperature which presents a serious obstacle to efforts to extinguish the blaze and shut down the flow of oil. Another obstacle is the damage that the production oil pipe has incurred as a result of the explosion. The damage often requires cutting or other treatment of the pipe before shut-off valves or other plugging means can be employed.

In the practice of the invention, a body of slitted and expanded metal foil is placed in a position above the flame and is maintained in that position until the flame is extinguished. The fire extinguishing capability of the metal net is based on the phenomenon that flame at the surface of a burning material cannot pass upwardly through the pores or eyes of the metal net. In a normal fire, the heat of the burning causes material at the surface of the fuel to vaporize and mix with the oxygen in the atmosphere above it to produce a flammable mixture. If the metal net of the present invention is interposed between the surface of the burning material and the atmosphere, the heat conductivity of the metal net reduces the heat of the fire and thus reduces the amount of vapor being produced. The net also prevents the flame at the surface of the burning material from reaching the flammable mixture of vapor and atmosphere above the fire, and for these two reasons the conditions for continued burning are removed and the fire is extinguished. In putting out the fire, the body of metal net causes the temperature of the gushing oil to be reduced from its flaming temperature of about 1,000 F. down to a temperature in the range of 700 to 800 F., where it is possible to carry out the remaining steps of bringing the flow of oil under control.

Figure 13:
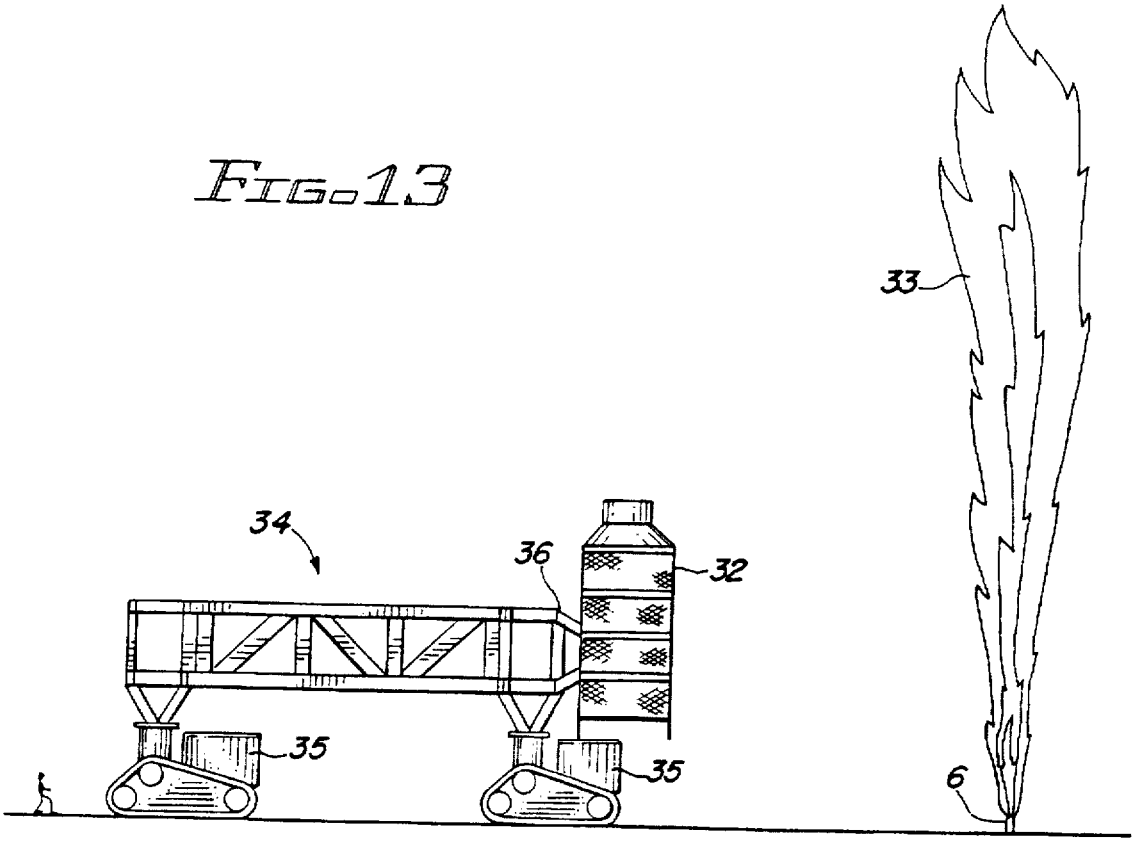
FIG. 13 is a schematic side view of a fire-fighting vehicle moving a body of contained ellipsoids of the present invention into position over a burning oil well.
Figure 14:
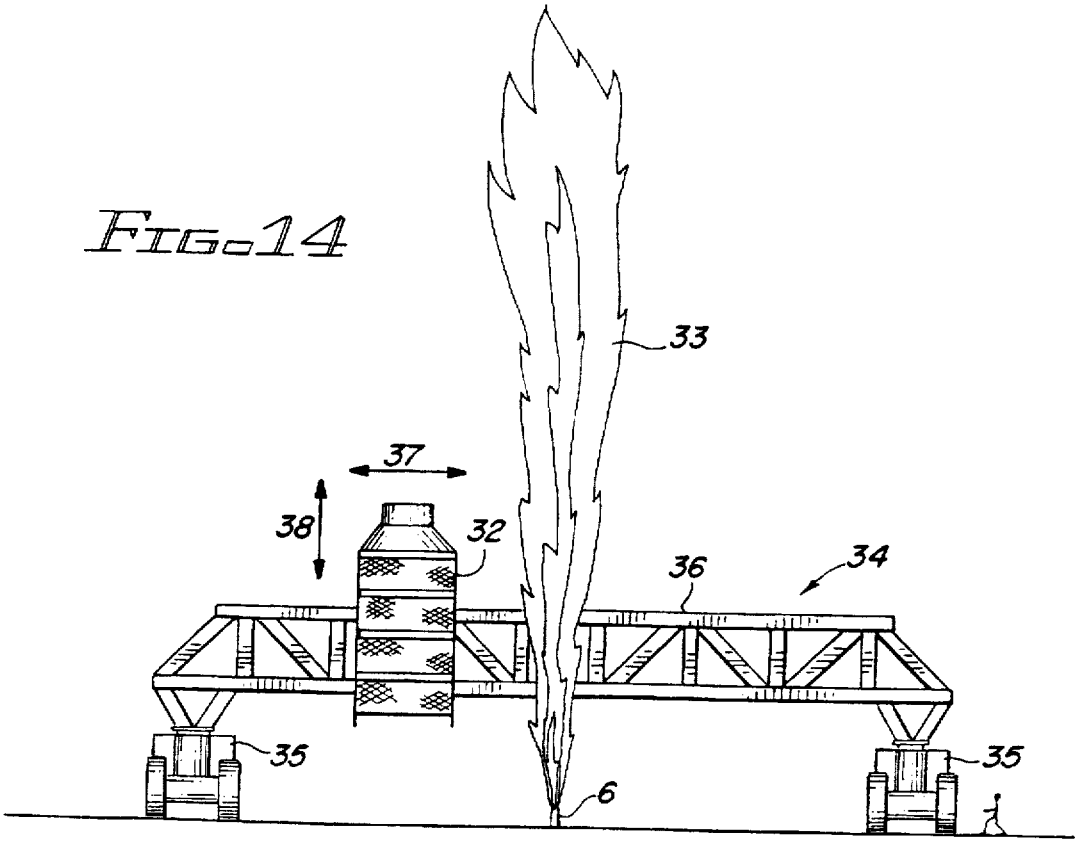
FIG. 14 is a schematic front view of the fire-fighting vehicle of FIG. 13.

FIGS. 13 and 14 illustrate a mechanism for placing a body of slitted and expanded metal foil 32 over the flame 33 of a burning oil well. The vehicle 34 for carrying and manipulating the body of expanded metal foil 32 is a very large structure weighing 735,000 Kg, powered by 4 modified Caterpillar tractors. The vehicle is 30 meters wide by 20 meters long. It carries a manipulator track 36 across the front for mounting the cylindrical body of expanded metal foil 32, and for mounting and manipulating the other tools necessary for bringing the gusher under control. In its preferred embodiment, the vehicle 34 is controlled remotely through a wide band telemetry line and has TV cameras mounted for remote viewing of the fire and the control operations. It may also have sensors for poison gas, fire temperature, and other variable conditions. The system for operating the vehicle 34 includes an air conditioned trailer (not shown) for remote control of the vehicle; remote control consoles with video displays and sensor readouts; and a laser triangulation system for precise location of the well.

In the embodiment shown in FIGS. 13 and 14, the cylindrical body of slitted and expanded metal foil is approximately 90 cubic meters in volume and weighs approximately 5 metric tons. As shown in FIG. 14, the cylinder 32 may be moved from side to side on the track 36 in the directions shown by arrow 37 until it is over the flame 33, and then it may be lowered, as shown by arrow 38, over the burning well with sufficient force to allow the body of expanded metal net 32 to extinguish the flame. After flame extinction, the cylindrical body 32 is raised and removed from the site, to make room for succeeding operations.

Although different forms of slitted and expanded metal foil may be used for the above purpose, it is preferred to use contained bodies of ellipsoids 2 as previously described in connection with the composition of collar 1 of the oil well anti-corrosion embodiment. As described, ellipsoids made from slitted and expanded metal foil are able to nestle closely together when placed in a contained position, so that complete coverage is obtained, with no gaps through which flame can pass. By using the ellipsoid form and by employing a strong and fire-resistant foil, such as a magnesium alloy, and by controlling the manner of slitting and expanding the foil, it is possible to produce expanded metal nets having exceptionally high specific internal surface areas (e.g., in the range of 250 to 325 $ft^2$ per $ft^3$ and above; exceptionally high porosity (e.g., in the range of 80 to 99%); and a volume resistivity of <50 ohm-m.

Table 1 below sets forth representative weights and volumes for bodies 32 of expanded metal net required to extinguish gusher fires in oil wells of varying oil flow:

TABLE 1

| Well Production Barrels/Day | Weight: Metric Tons of Ellipsoids | Volume: Cubic Meters of 2% Density Ellipsoids |
|---|---|---|
| 1,000 | 1.00 | 18.14 |
| 5,000 | 4.99 | 90.70 |
| 10,000 | 9.98 | 181.40 |
| 15,000 | 14.97 | 272.09 |
| 20,000 | 19.97 | 362.09 |
| 50,000 | 49.99 | 906.98 |

Figure 15:
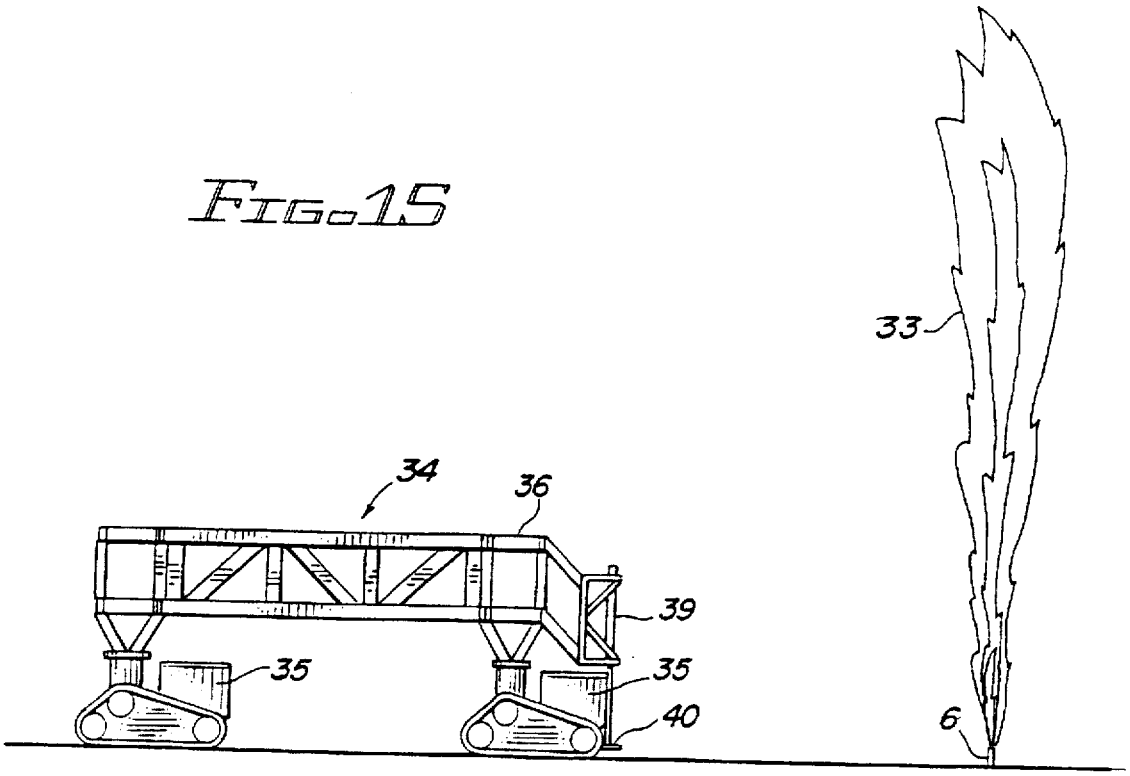
FIG. 15 is a schematic side view of a fire-fighting vehicle moving a rotary cutter into position for cutting off the damaged end of the production pipe of a burning oil well.
Figure 16:
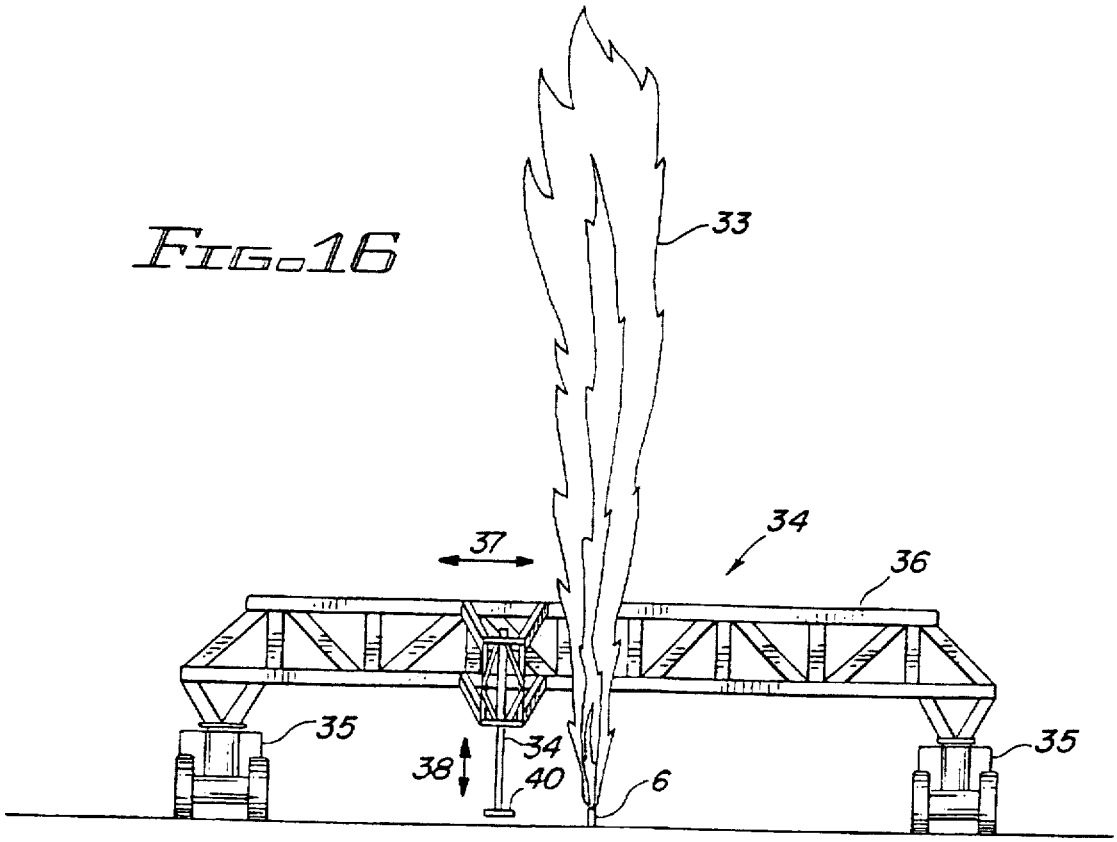
FIG. 16 is a schematic front view of the fire-fighting vehicle of FIG. 15.

When the fire has been extinguished, the gusher is reduced to a flow of non-burning oil having a temperature in the range of 700 to 800 F. This can ordinarily be accomplished in about 1 to 2 minutes, and after an additional 4 to 10 minutes the cooling effect of the oil passing through the expanded metal net brings the temperature down to 350 to 400 F. At this point, the oil well has been brought to a state in which the remaining operations of plugging the well pipe and/or installing a turn-off valve can be accomplished. If the well pipe has been damaged, it is preferred, as the next step, to cut off the damaged part of the pipe. For this purpose, the vehicle 34 may be fitted with a cutting tool, as shown in FIGS. 15 and 16. In this operation, a cutting tool 39 having a rotary cutter 40 with a blade having a diameter of, for example, 1.5 meters, is mounted on the track 36 and moved into position in order to cut off the damaged well pipe 6 at a point below the damage, thus providing a clean, undamaged end which can be worked with in the succeeding plugging and cut-off operations. The cutting operation can also be carried out before extinguishing the flame, and in some cases this is preferred, in order to cause the flame to burn cleaner and avoid re-starting of the fire after it has been extinguished.

Figure 19:
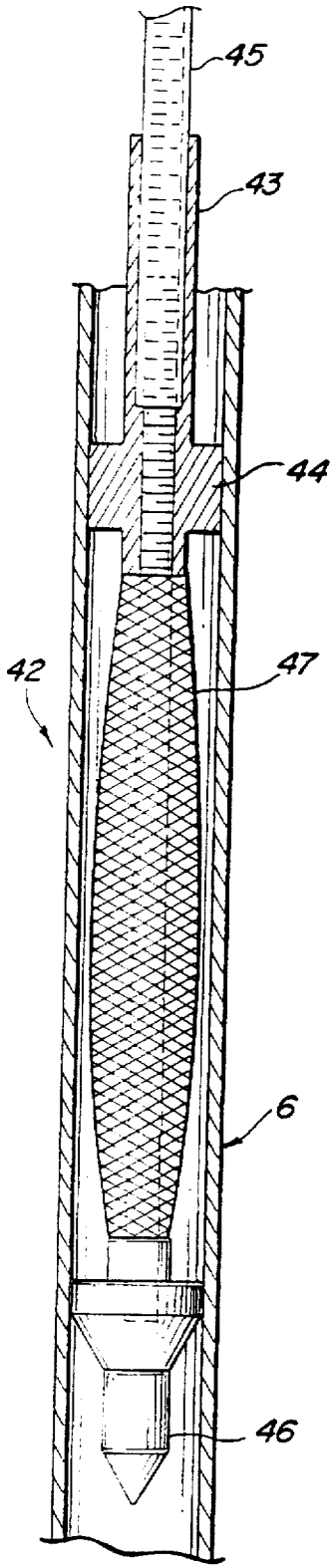
FIG. 19 is a cross-sectional view of the well pipe plug.
Figure 17:
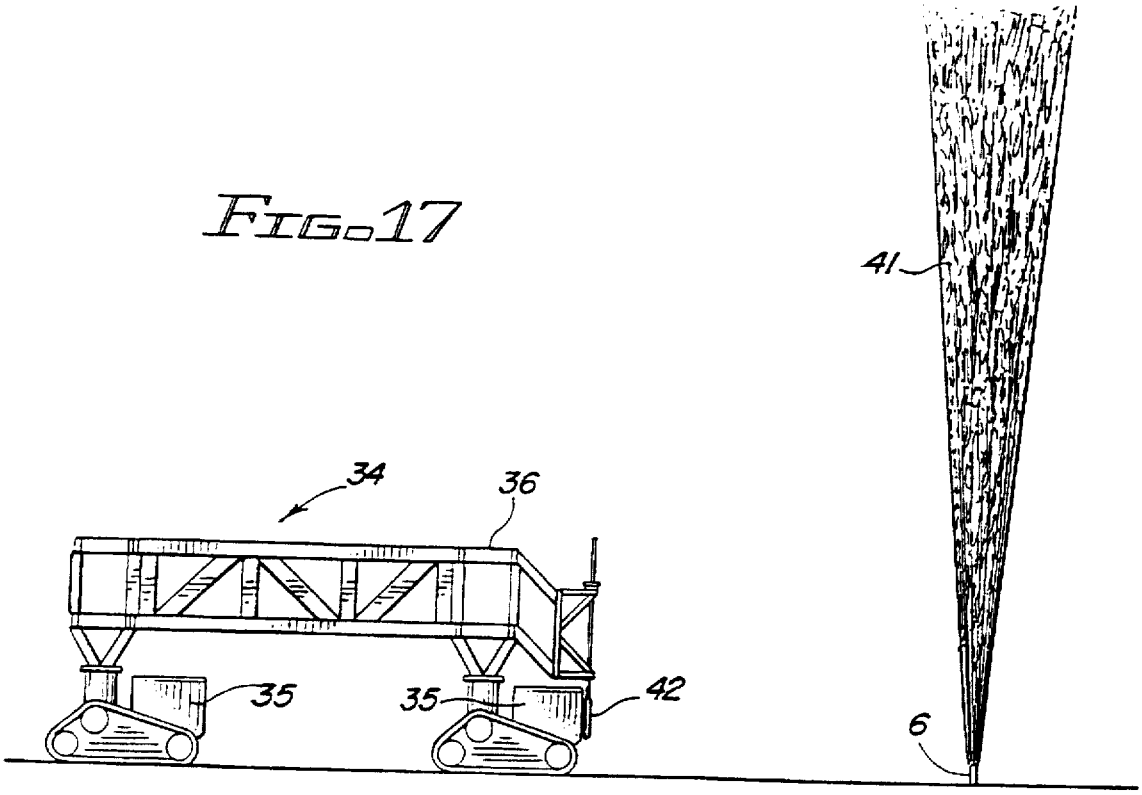
FIG. 17 is a schematic side view of a fire-fighting vehicle moving a well pipe plug into position for insertion into the end of the production pipe of a burning oil well.
Figure 18:
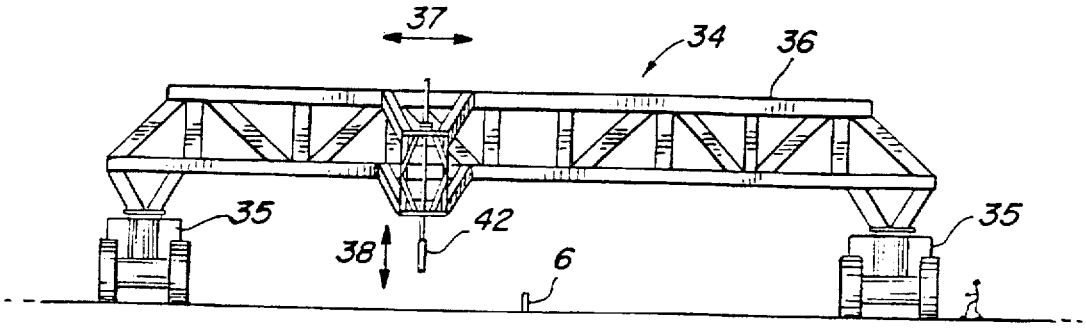
FIG. 18 is a schematic side view of the fire-fighting vehicle of FIG. 17.

When the fire is extinguished and the upper end of the well pipe 6 has been cut, the oil well is ready for the next step of plugging the pipe. For this purpose, the vehicle 34 may be used to insert a plug, as shown in FIGS. 17, 18 and 19, in which the non-burning gusher of oil is represented by the numeral 41. In this operation, a well plug 42 is mounted on the track 36 of the vehicle 34 and is lowered for insertion into the well pipe 6. As shown in detail in FIG. 19, the plug 42 comprises a plug compression pipe 43, a compression retainer 44 attached thereto, an internally threaded steel rod 45 carried inside the compression pipe 43, a plug insert and retainer 46 positioned at the leading end of the plug, and a stainless steel wire mesh plugging element 47 positioned between the compression retainer 44 and the plug insert and retainer 46. When the plug 42 has been inserted to the required depth (up to 7 meters) within the well pipe, the compression rod 45 is rotated while the compression pipe 43 is held in a fixed position. As the compression rod is rotated, the stainless steel mesh 47 expands to make a tight seal of the well pipe. The plug 42 is then released by the machine 34 and left in the well pipe. A new valve can then be installed over the plug and turned off. When the valve is in place, the compression rod 45 is rotated in the reverse direction, and the plug 42 is removed. After holding the well in the off position for a period of about 2 hours, the valve can be turned on and the well placed back in operation.

Figure 20:
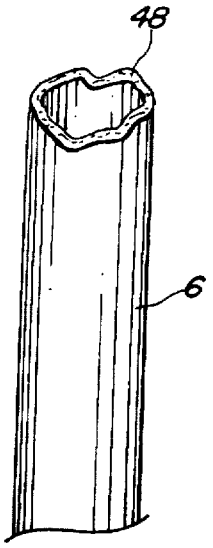
FIG. 20 is a perspective view of the end of an oil well production pipe.
Figure 21:
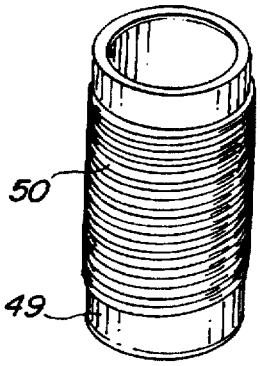
FIG. 21 is a perspective view of an externally threaded shape memory fitting, adapted to be shrink-fitted to the end of the oil well pipe of FIG. 20.
Figure 22:
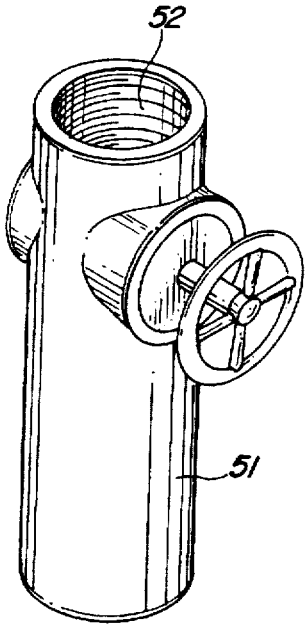
FIG. 22 is a perspective view of an internally threaded shut-off valve, adapted to be threaded onto the fitting of FIG. 21.

FIGS. 20 through 25 illustrate a form of shut-off valve which is preferred for use in the present invention. The well pipe 6 is shown in FIG. 20 with a somewhat misshapen outer end 48, and it may be desired, although not necessary, to cut this off, using the apparatus of FIGS. 15 and 16, before proceeding with installation of the valve. FIG. 21 shows a tubular fitting 49 with external threading 50. The fitting 50 has an inside diameter slightly larger than the outside diameter of the well pipe 6. FIG. 22 illustrates a shut-off valve 51 having internal threads 52.

Figure 23:
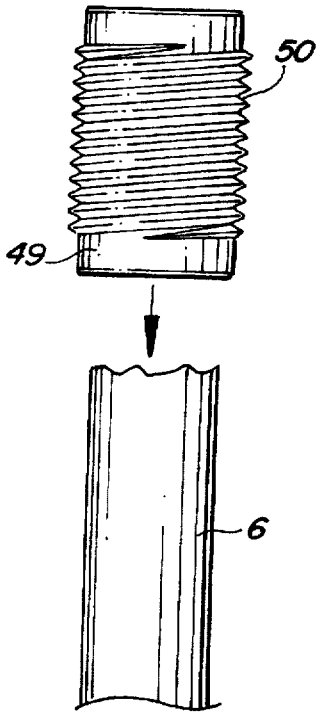
FIG. 23 is a side view of the shape memory fitting, ready to be placed on the end of the oil well pipe.
Figure 24:
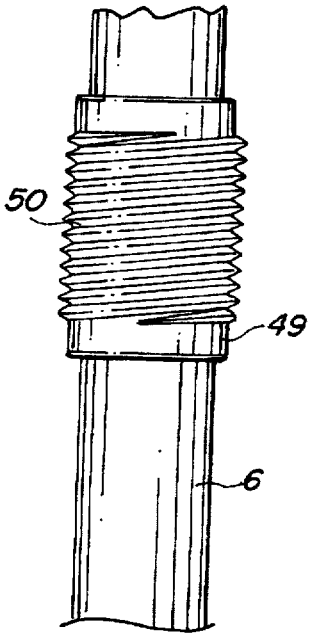
FIG. 24 is a side view of the shape memory fitting which has been shrink fitted onto the oil well pipe.
Figure 25:
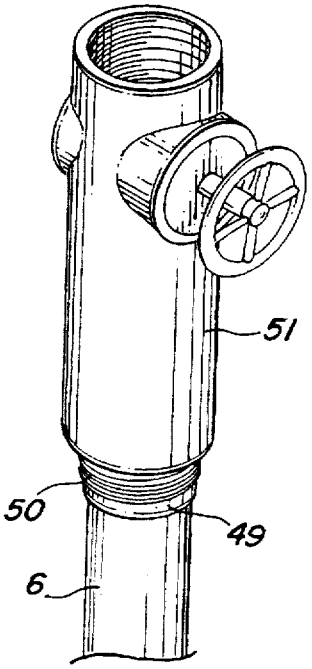
FIG. 25 is a perspective view of the assembly in which the internally threaded shut-off valve has been threaded onto the externally threaded shape memory fitting.

In the installation sequence shown in FIGS. 23 through 25, the tubular fitting 49 is slipped over the upper end of the well pipe 6, and the inside surface of the fitting 49 is sealed to the outside surface of the pipe 6. The shut-off valve 51 is then threaded onto the fitting 49, and the valve can then be turned off to stop the flow of oil out the upper end of the well pipe, and the well plug may then be removed, as described above. Finally, after a stabilization period of approximately two hours, the valve can be opened, and the normal operation of the well resumed.

In the installation of the shut-off valve, it is preferred to use a tubular fitting 49 which is made of a shape-memory material which may be shrink fitted to the well pipe 6. A suitable material for the fitting 49 is a nickel-titanium alloy, with shape-memory characteristics, sold under the name CryoFit by Raychem Corporation, of Menlo Park, Calif. The shape-memory property of such material allows the fitting 49 to shrink when its temperature is raised. When used in the present invention, the fitting 49 made of this material may be preliminarily stored at cryogenic temperatures, such as in liquid nitrogen, and then, when the chilled fitting is slipped onto the well pipe 6 and is subjected to the elevated temperature of the pipe and the contained hot oil, the fitting shrinks and crimps down on the pipe with tremendous force, forming a permanent, metal-to-metal connection. The internally threaded valve 51 may then be threaded onto the fitting and is ready for the shut-off operation.

Although preferred embodiments of the invention have been described herein in detail, it will be understood by those skilled in the art that variations may be made thereto without departing from the spirit of the invention.

What is claimed is:

1. A module for providing protection against corrosion, fire and explosion in a downhole oil well casing having a production pipe concentrically positioned inside said casing and having an annular space between said casing and said pipe, comprising a collar formed from slitted expanded metal net located in said annular space and encircling said pipe.

2. A module as in claim 1 wherein said collar has a porosity greater than 80%.

3. A module as in claim 1 wherein said collar has an internal surface area greater than 250 square feet per cubic foot.

4. A module as in claim 1 wherein said expanded metal net is made from aluminum foil.

5. A module as in claim 1 wherein said expanded metal net is made from magnesium alloy foil.

6. A module as in claim 1 wherein said collar is a contained layer of nested ellipsoids formed from expanded metal alloy sheets.

7. A module as in claim 6 wherein said nested ellipsoids are contained between layers of expanded metal alloy sheets.

8. An oil well which is protected against corrosion, fire and explosion, comprising:

a. a downhole casing connecting with a subsurface oil production zone at its lower end and with a surface wellhead at its upper end;

b. a concentrically positioned downhole production pipe located inside said casing, with an annular space between said casing and said pipe; and c. a protective collar located in said annular space for prevention of corrosion of said casing and said pipe and for prevention of fire and explosion within said annular space, said collar formed from slitted and expanded metal net.

9. An oil well as in claim 1 wherein said collar has a porosity greater than 80%.

10. An oil well as in claim 8 wherein said collar has an internal surface area greater than 250 square feet per cubic foot.

11. An oil well as in claim 8 wherein said expanded metal net is made from aluminum foil.

12. An oil well as in claim 8 wherein said expanded metal net is made from magnesium alloy foil.

13. A module as in claim 8 wherein said collar is a contained layer of nested ellipsoids formed from expanded metal alloy sheets.

14. A module as in claim 11 wherein said nested ellipsoids are contained between layers of expanded metal alloy sheets.

15. An oil well which is protected against corrosion, fire and explosion, comprising:

a. a downhole casing connecting with a subsurface oil production zone at its lower end and with a surface wellhead at its upper end;

b. a concentrically positioned downhole production pipe located inside said casing, with an annular space between said casing and said pipe;

c. a centralizing device comprising a pair of spaced apart rings encircling said production pipe and multiple spaced apart slats having a first end, a second end and a midsection, the first ends of said slats being secured to one of said rings and the second ends of said slats being secured to the other of said rings, with the midsections of said slats bowed outwardly away from said production pipe and in contact with said casing; and d. a protective collar located in said annular space between said pipe and said casing and positioned between said spaced apart rings, for prevention of corrosion of said casing and said pipe and for prevention of fire and explosion within said annular space, said collar formed from slitted and expanded metal net.

16. An oil well which is protected against corrosion, fire and explosion, comprising:

a. a downhole casing connecting with a subsurface oil production zone at its lower end and with a surface wellhead at its upper end;

b. a concentrically positioned downhole production pipe located inside said casing, with an annular space between said casing and said pipe;

c. a first protective collar located in said annular space, at a point adjacent said wellhead, said first collar formed from slitted and expanded metal net; and d. a second protective collar located in said annular space, at a point adjacent said production zone, said second collar formed from slitted and expanded metal net, whereby said first and second collars cooperate to prevent oxygen and hydrocarbon vapors from entering the said annular space extending between said collars and thus prevent corrosion and fire or explosion.

* * * * *

UNITED STATES PATENT AND TRADEMARK OFFICE

CERTIFICATE OF CORRECTION

PATENT NO. : 5,794,706
DATED : August 18, 1998
INVENTOR(S) : Ghaleb Mohammad Yassin Alhamad It is certified that error appears in the above-indentified patent and that said Letters Patent is hereby corrected as shown below:

In claim 9, line 44 the number "1" should be deleted and the number --8-- should be inserted; and In claim 14, line 57 the number "11" should be deleted and the number --13-- should be inserted.

Signed and Sealed this

Tenth Day of November 1998

*Attest:*

*Attesting Officer*

BRUCE LEHMAN

*Commissioner of Patents and Trademarks*